US010196076B2

(12) United States Patent
Brook et al.

(10) Patent No.: US 10,196,076 B2
(45) Date of Patent: Feb. 5, 2019

(54) COUPLER KNUCKLE

(71) Applicant: Pennsy Corporation, West Chester, PA (US)

(72) Inventors: Zachary Ryan Brook, Leola, PA (US); Manuel Tavares, Doylestown, PA (US); Michael J. Schmidt, Norristown, PA (US)

(73) Assignee: Pennsy Corporation, West Chester, PA (US)

( * ) Notice: Subject to any disclaimer, the term of this patent is extended or adjusted under 35 U.S.C. 154(b) by 182 days.

(21) Appl. No.: 15/230,047

(22) Filed: Aug. 5, 2016

(65) Prior Publication Data

US 2016/0339931 A1 Nov. 24, 2016

Related U.S. Application Data

(63) Continuation of application No. 14/171,719, filed on Feb. 3, 2014, now Pat. No. 9,481,380, which is a continuation-in-part of application No. 13/842,229, filed on Mar. 15, 2013, now Pat. No. 9,199,652, which is a continuation-in-part of application No. 13/678,021, filed on Nov. 15, 2012, now abandoned.

(51) Int. Cl.

| | |
|---|---|
| ***B61G 7/00*** | (2006.01) |
| ***B61G 3/04*** | (2006.01) |
| ***B61G 1/28*** | (2006.01) |

(52) U.S. Cl.

CPC ..... *B61G 7/00* (2013.01); *B61G 1/28* (2013.01); *B61G 3/04* (2013.01)

(58) Field of Classification Search

CPC ... B61G 3/00; B61G 3/02; B61G 3/04; B61G 3/06; B61G 3/28; B61G 3/30; B61G 7/00; B61G 7/08

See application file for complete search history.

(56) References Cited

U.S. PATENT DOCUMENTS

| | | | |
|---|---|---|---|
| 559,005 | A | 4/1896 | Timms |
| 2,088,135 | A | 7/1937 | Johnson et al. |
| 2,688,412 | A | 9/1954 | Kulieke |
| 3,604,569 | A | 9/1971 | Kulieke |
| 3,635,280 | A | 1/1972 | Parsons |
| 3,853,228 | A | 12/1974 | Metzger |
| 4,081,082 | A | 3/1978 | Scherrer et al. |
| 4,206,849 | A | 6/1980 | Kaim |

(Continued)

OTHER PUBLICATIONS

Brandenberg, Kristin; "Successfully Machining Austempered Ductile Iron (ADI)"; Applied Process Inc. Technologies Div.—Livonia, Michigan, USA; Oct. 2001.

(Continued)

*Primary Examiner* — Robert J McCarry, Jr.

(74) *Attorney, Agent, or Firm* — John F. A. Earley, III; Frank J. Bonini, Jr.; Harding, Earley, Follmer & Frailey, PC

(57) ABSTRACT

An improved coupler knuckle with an improved interior configuration for handling forces imparted on the knuckle and transferring said imparted forces through the knuckle and improving handling of linear force loads and their transmission the interior having a force handling structure that includes spaced apart layers and cavities, with a cavity extending between the nose section and the tail section of the coupler knuckle.

23 Claims, 16 Drawing Sheets
(10 of 16 Drawing Sheet(s) Filed in Color)

(56) References Cited

U.S. PATENT DOCUMENTS

| | | | | |
|---|---|---|---|---|
| 4,605,133 | A | 8/1986 | Altherr | |
| 4,640,422 | A | 2/1987 | Elliott | |
| 4,645,085 | A | 2/1987 | Hanula et al. | |
| 4,987,945 | A | 1/1991 | Corbett | |
| 5,410,968 | A | 5/1995 | Hawthorne et al. | |
| 5,481,986 | A | 1/1996 | Spencer et al. | |
| 5,582,307 | A | 12/1996 | Hawthorne et al. | |
| 5,878,897 | A | 3/1999 | Lazzaro et al. | |
| 5,900,082 | A | 5/1999 | Hewitt | |
| 5,954,212 | A | 9/1999 | Beatty et al. | |
| 6,129,227 | A * | 10/2000 | Openchowski | B61G 3/04 213/111 |
| 6,173,655 | B1 | 1/2001 | Hawthorne | |
| 6,796,448 | B1 | 9/2004 | Wilt et al. | |
| 7,302,944 | B2 | 12/2007 | Judson | |
| 7,302,994 | B2 | 12/2007 | Mautino et al. | |
| 7,337,826 | B2 | 3/2008 | Mautino et al. | |
| 7,757,871 | B2 | 7/2010 | Mautino et al. | |
| 8,056,741 | B2 | 11/2011 | Mautino et al. | |
| 8,196,762 | B2 | 6/2012 | Smerecky | |
| 8,201,613 | B2 | 6/2012 | Marchese et al. | |
| 8,297,455 | B2 | 10/2012 | Smyth | |
| 8,302,790 | B2 | 11/2012 | Dumey | |
| 8,381,923 | B2 | 2/2013 | Smyth | |
| 8,408,406 | B2 | 4/2013 | Smerecky et al. | |
| 8,408,407 | B2 | 4/2013 | Nibouar et al. | |
| 8,485,371 | B2 | 7/2013 | Nibouar et al. | |
| 8,499,819 | B2 | 8/2013 | Nibouar et al. | |
| 8,544,662 | B2 | 10/2013 | Smerecky et al. | |
| 8,631,952 | B2 | 1/2014 | Smerecky | |
| 8,646,631 | B2 | 2/2014 | Marchese et al. | |
| 8,662,327 | B2 | 3/2014 | Nibouar | |
| 8,695,818 | B2 | 4/2014 | Nibouar et al. | |
| 2005/0178521 | A1 | 8/2005 | Grassi | |
| 2009/0242160 | A1 | 10/2009 | Obara | |
| 2013/0177469 | A1 | 7/2013 | Ruhlman | |

OTHER PUBLICATIONS

A. Kahn and B.K. Chen, "Evaluation of Grade 1 Austempered Ductile Iron for Application to Rail Cast Components", Proceedings of the Fifth Asia Pacific Industrial Engineering and Management Systems Conference 2004, at Gold Coast, Australia.

Luís Magalhães, Jorge Seabra, "Teeth Surface Failures in Austempered Ductile Iron (ADI) Gears", Gears and Transmission Workshop, Paper No. XIII, p. 269-286, Faculdade de Engen.

Stokes B. et al.; "Effects of Carbides on Fatigue Characteristics of Austempered Ductile Iron", Metallurgical and Materials Transactions A, 36 (2005) 977-988.

Bubenko et al.; "Fatigue Crack Propagation through Austempered Ductile Iron Microstructure"; Materials Engineering, vol. 17, 2010, No. 3, p. 15-20.

Bubenko et al.; "Fatigue Crack Propagation Within the Austempered Ductile Iron Microstructure"; Acta Metallurgica Slovaca, vol. 17, 2011, No. 1, p. 18-25.

Dundar, Sacit; "Application of Austempered Ductile Iron to Rail Wheel Sets"; Journal of Engineering Sciences 2003, 9 (3), p. 283-287.

International ADI and Simulation Conference; May 28-30, 1997.

Knuckles, Types E and F—Fatigue Test, AAR Manual of Standards and Recommended Practices Castings, 2009, [M-216] 1-2.

Keough J. R., et al.; "Continuing Developments in the Science and Application of Austempered Ductile Iron (ADI)"; 2012.

AAR Manual of Standards and Recommended Practices Casting Details; Castings, Steel; Specification M-201; S [M-201] 41-S [M-201] 49.

AAR Manual of Standards and Recommended Practices Casting Details; S [M-211] 143-S [M-211] 149.

AAR Manual of Standards and Recommended Practices Casting Details; Coupling Systems; Specification M-215; S [M-215] 337-S [M-215] 342.

"The Six Standard ADI Grades Per ASTM A897/A897M-06"; www.appliedprocess.com; Issued Nov. 4, 2008.

AAR Manual of Standards and Recommended Practices Casting Details; Truck Bolsters, Cast or Structural—Design and Testing; Specification M-202; S [M-202] 51-S [M-202] 64.

AAR Manual of Standards and Recommended Practices Casting Details; Truck Side Frames, Cast Steel—Design and Testing; Specification M-203; S [M-203] 65-S [M-203] 76.

AAR Manual of Standards and Recommended Practices Casting Details; Bolster Design Loads; Specification M-203A; S [M-203A] 77-S [M-203A] 82.

AAR Manual of Standards and Recommended Practices Trucks and Truck Details; Truck Performance for Rail Cars; Specification M-976; D [M-976] 31-D [M-976] 38.

"Ductile Iron"; Wikipedia, the free encyclopedia; http://en.wikipedia.org/wiki/Ductile_iron#Composition; p. 1-3.

Hayrynen, Kathy L.; The Production of Austempered Ductile Iron (ADI); 2002 World Conference on ADI.

Aristizabal, Ricardo E.; "Intercritical Heat Treatments in Ductile Iron and Steel"; Materials Science and Engineering; Birmingham, Alabama; 2012.

FerroPem—Groupe-FerroAtlántica; Newsletter—Jan. 2012.

SAIFoundry; "Austempered ductile iron production properties";http://www.slideshare.net/SAIFoundry/austempered-ductile-iron-production-properties-applications#;Mar. 19, 2012.

* cited by examiner

COUPLER KNUCKLE

CROSS-REFERENCE TO RELATED APPLICATIONS

This is a continuation of U.S. application Ser. No. 14/171,719, filed on Feb. 3, 2014, which is a continuation-in-part of U.S. application Ser. No. 13/842,229, filed on Mar. 15, 2013, which is a continuation-in-part of Ser. No. 13/678,021, filed on Nov. 15, 2012, the complete contents of which are herein incorporated by reference.

BACKGROUND OF THE INVENTION

Field of the Invention

The present invention relates to the field of coupler knuckles for use in coupling railroad cars and more particularly to a coupler knuckle designed to be stronger, have improved resistance to fatigue and have improved force handling characteristics.

Brief Description of the Related Art

Railroad vehicles are generally connected together with couplers. Railroad couplers are typically constructed to railroad standards so that couplers used on railroad cars may be coupled together, even if produced by different manufacturers. Common knuckles are American Association of Railroads ("AAR") Standard E and F type railroad car couplers, and, in particular, the knuckles used in these couplers.

Railcar couplers are disposed at each end of a railway car to enable joining one end of such railway car to an adjacently disposed end of another railway car. The engageable portions of each of these couplers are known in the railway art as a knuckle. For example, railway freight car coupler knuckles are disclosed in numerous U.S. patents, such as, for example, including in the following U.S. patent documents: U.S. Pat. Nos. 461,312; 533,985; 693,998; 2,689,051; 2,088,135; 4,024,958; 4,206,849; 4,605,133; 5,582,307; 8,297,455 and U.S. patent application no. 2009/0289024. In addition, lightweight railway freight car coupler knuckles are disclosed in U.S. Pat. Nos. 5,954,212 and 6,129,227.

Coupler knuckles are generally manufactured from cast steel weighing approximately 84 lbs. The cast steel used is grade E, tensile strength 120,000 psi, yield strength of 100,000 psi, elongation of 14%, reduction of area 30%. These knuckles fatigue crack over time, which eventually leads to knuckle failure.

Knuckle failure accounts for about 100,000 train separations a year, or about 275 separations per day. Most of these separations occur when the train is out of a maintenance area. In such cases, a replacement knuckle, which can weigh about 80 pounds, must be carried from the locomotive at least some of the length of the train, which may be up to 25, 50 or even 100 railroad cars in length. The repair of a failed coupler knuckle can be labor intensive, can sometimes take place in very inclement weather, can cause train delays and delays and, due to its excessive weight, subjects the carrier or carriers to potential lifting related injuries.

The front core of a knuckle is commonly referred to as the finger core. The finger core is commonly constructed to produce an internal cavity having thin ribs. These ribs made out of the standard grade E cast steel have demonstrated a weakness to the load environment with the development of fatigue and/or hot tear cracks. The fatigue cracks can grow over time and eventually lead to knuckle failure which results in separation of railcars. Separately, internal or external cracks in the knuckle are a cause for replacement of the knuckle. The rear core of a knuckle is commonly referred to as the kidney core. Knuckles can sometimes break within this portion of the knuckle and this has proven to be a very undesirable location for a failure. A failure in this region of the knuckle can lead to knuckle jamming within the coupler body and prevent a change out of a failed knuckle, thereby requiring the entire coupler assembly to be replaced, a very costly repair.

The core of the finished knuckle is generally seen as a cavity in the knuckle. However, it is the practice of a knuckle that is cast to cast the knuckle around a core. The common practice is to utilize a core within the casting, and then break the core apart when the knuckle has been cast. This practice, aside from being time consuming, generally requires precise positioning of the core, such as, in a jig, and that the core remain in position during the casting process. The present methods used for forming knuckles have drawbacks and are known to produce failures in the final product when the core is misaligned or has shifted during the forming process.

There is a need for a process for producing a knuckle that may be done with improved precision and less waste, and for a knuckle having improved capabilities for handling forces and having improved strength or fatigue life.

In addition, there is a need for a lightweight knuckle that is lower in weight than conventional knuckles and with strength or fatigue life similar to or exceeding those of heavier knuckles, where the lightweight knuckle operates to be the weak link in the coupler system and fail under high loading conditions.

SUMMARY OF THE INVENTION

An improved coupler knuckle is provided. The improved coupler knuckle is designed to facilitate handling of force loads transmitted to the coupler knuckle through components of the coupling system, the vehicle to which the coupler is associated and other coupler knuckles (e.g., of an adjacent vehicle) that are in engagement with the coupler knuckle.

The improved coupler knuckle has improved force handling properties.

It is an object of the invention to produce an improved coupler knuckle that has an interior construction to facilitate improved force handling and transmission of force loads through the knuckle, including from one end of the knuckle to the other.

It is another object of the invention to provide an improved knuckle and a process for producing an improved knuckle, where the knuckle has increased fatigue resistance and improved strength.

It is another object of the invention to produce a knuckle that has a plurality of spaced apart layers in the knuckle interior which are separated by cavities.

It is another object of the invention to produce a knuckle that has improved strength without adding to the weight of the knuckle.

It is another object of the invention to provide an improved lightweight knuckle that is suitably strong while also still allowing the knuckle to handle stress and force loads imparted thereon by the railway vehicle, its contents and adjoining vehicles or engines.

It is another object of the invention to provide an improved knuckle that is reduced in weight while having equal or, preferably greater, fatigue resistance.

These and other advantages are provided by the invention.

BRIEF DESCRIPTION OF THE DRAWING FIGURES

The patent or application file contains at least one drawing executed in color. Copies of this patent or patent application publication with color drawing(s) will be provided by the Office upon request and payment of the necessary fee.

FIGS. 11-20 are illustrations showing a knuckle according to the invention represented in a von-Mises stress evaluation, with FIGS. 11, 13, 15, 17 and 19 show stress results for a knuckle according to the present invention, and wherein FIGS. 12, 14, 16, 18 and 20 show stress results for a prior art type E coupler knuckle.

DETAILED DESCRIPTION OF THE PREFERRED EMBODIMENTS

Figure 5:
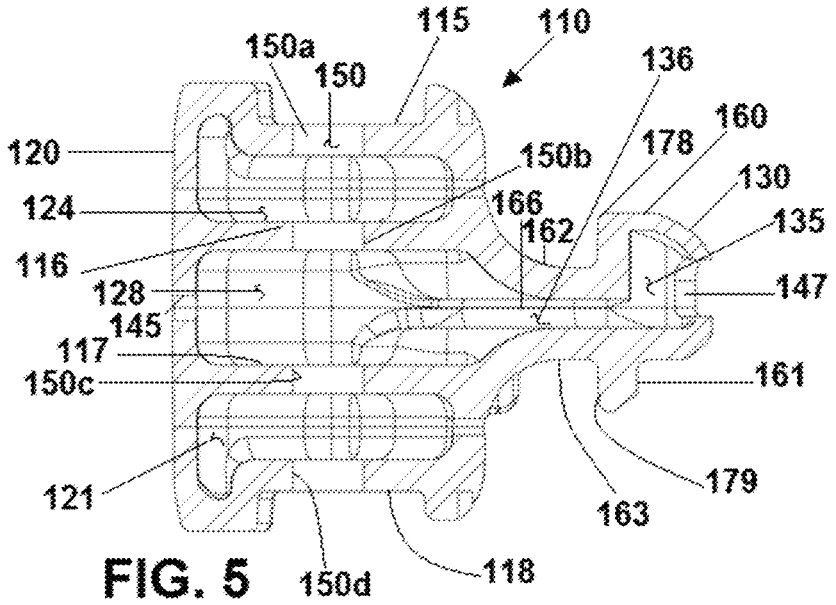
FIG. 5 is a vertical sectional view thereof taken along the section line 5-5 of FIG. 4.
Figure 6:
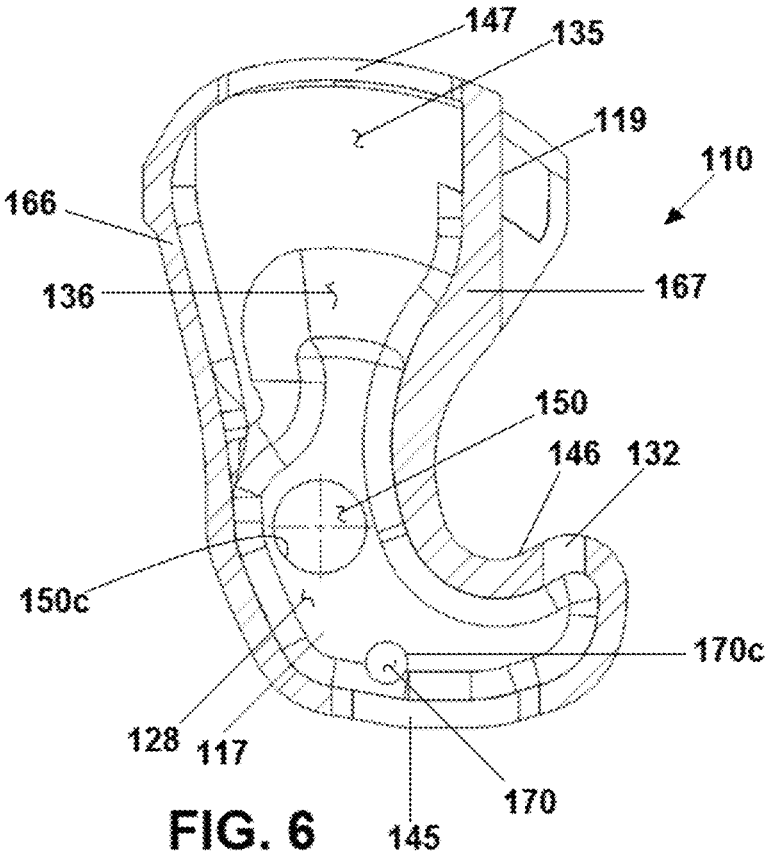
FIG. 6 is a transverse sectional view thereof, taken along the section line 6-6 of FIG. 2.
Figure 7:
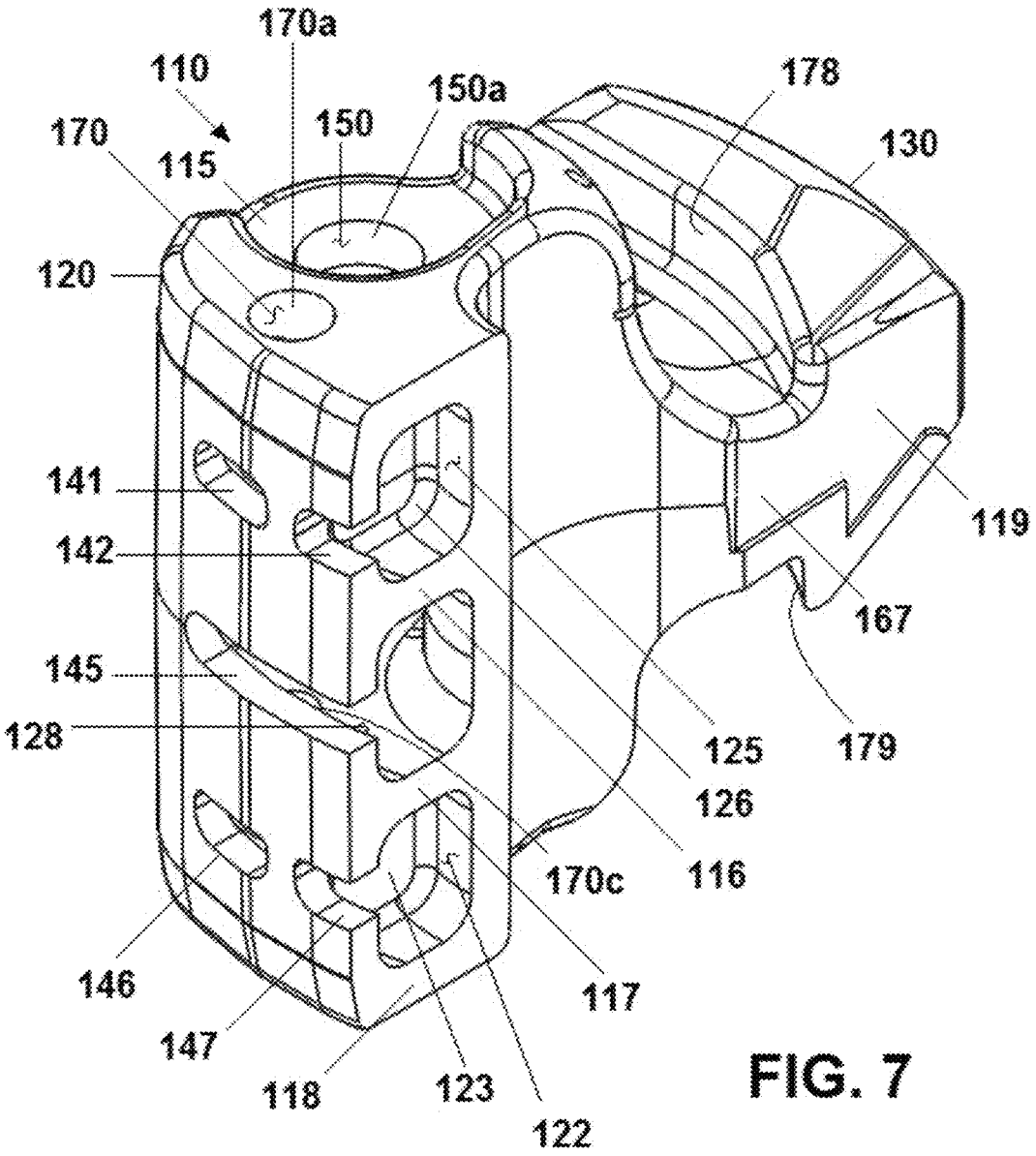
FIG. 7 is a sectional view thereof taken through the section line 7-7 of FIG. 4, as viewed in perspective looking from the nose.
Figure 8:
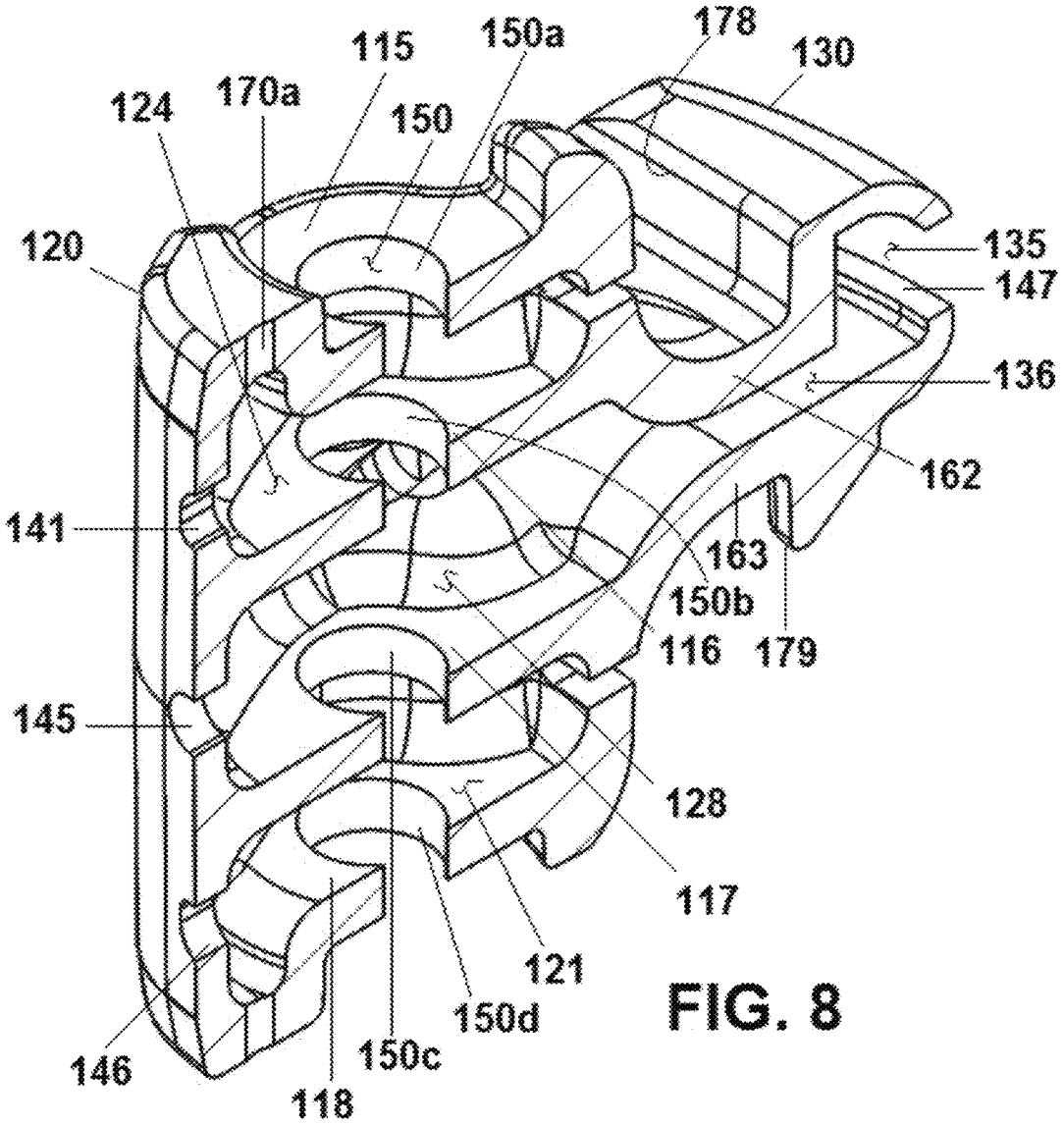
FIG. 8 is a sectional view thereof, in perspective, taken through the section line 8-8 of FIG. 1.

FIGS. 1-8 illustrate a preferred embodiment of a coupler knuckle 110 in accordance with the invention. The coupler knuckle 110 may be constructed through prior methods, or, preferably from the method illustrated and described in our co-pending U.S. patent application Ser. No. 14/171,700, filed on Feb. 3, 2014, for a process for producing a coupler knuckle and improved coupler knuckle, the complete contents of which are herein incorporated by reference. The coupler knuckle 110, according to a preferred embodiment, has an improved interior configuration for facilitating improved force handling. According to preferred embodiments, the knuckle 110 is configured to evenly distribute forceloads through the knuckle to reduce stresses and improve resistance to fatigue. The coupler knuckle 110 is illustrated in the drawing FIGS. 1-8. The coupler knuckle 110 includes a force handling structure, which preferably has one or more transverse layers that span across the knuckle interior, and which are separated by cavities. Referring to FIGS. 6-8, the knuckle 110 is shown according to a preferred embodiment having a plurality of interior cavities, including nose cavities, such as the nose cavities 121,124 and 128 and a tail cavity 135. In addition, nose cavities 122,125 are provided, and are located on an opposite side of a respective wall 123,126 (FIG. 7) respectively, and opposite of the respective nose cavities 124,121 (FIG. 8).

The knuckle 110 preferably is constructed with an improved force handling construction, which preferably, includes a plurality of layers 115,116,117,118 which are separated by cavities therebetween, including the cavities 124,125,128,121,122, as may be best viewed in FIGS. 5 through 8. The layers include an upper layer 115 which is shown forming an upper surface of the top of the knuckle 110, and a lower layer 118 forming a lower surface of the bottom of the knuckle 110. A first wall section 126 separates the upper cavities 124,125, and a second wall section 123 separates the lower cavities 121,122. A mid cavity 128 is shown between the mid layers 116,117. According to a preferred embodiment, the mid layers 116,117 are disposed for alignment in a direction of anticipated and expected pulling forces, when the knuckle 110 is employed on a railroad car coupling, and a pulling force is exerted on the knuckle 110.

Referring to FIG. 5, according to a preferred embodiment, the first mid layer 116 is shown disposed for alignment with the upper portion 160 of the tail or tail section 130, and the second mid layer 117 preferably is disposed for alignment with the lower portion 161 of the tail or tail section 130. Preferably, the knuckle 110 includes an upper wall 162 and a lower wall 163 which preferably extend from the nose section 120 to the tail section 130. A cavity 135 is provided in the tail section 130, and the tail section 130 has an opening 147 therein. The tail cavity 135 connects with a cavity or channel 136, which is shown communicating with a nose cavity, and preferably the mid cavity 128. A first sidewall portion 166 (FIG. 5) and second sidewall portion 167 (FIG. 2) are provided between the nose portion 120 and tail portion 130, and are shown defining the channel or cavity 136. The layers 115,116,117,118, according to a preferred configuration, are transversely spaced apart and separate the cavities in the knuckle 110, with adjacent layers defining a cavity therebetween. The coupler knuckle 110 also has a locking face 119 provided at the tail portion 130.

Figure 1:
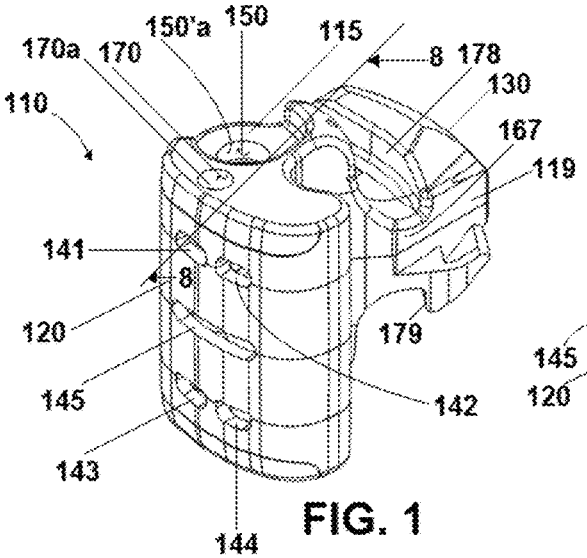
FIG. 1 is a perspective view of a knuckle constructed in accordance with the invention.
Figure 2:
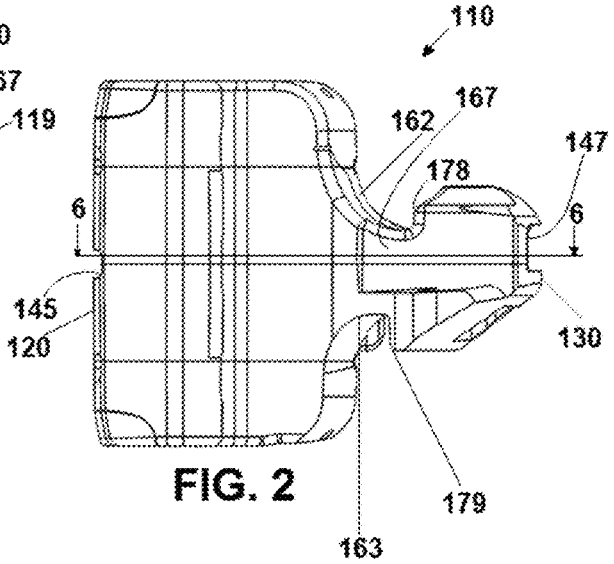
FIG. 2 is a right side elevation view thereof.
Figure 3:
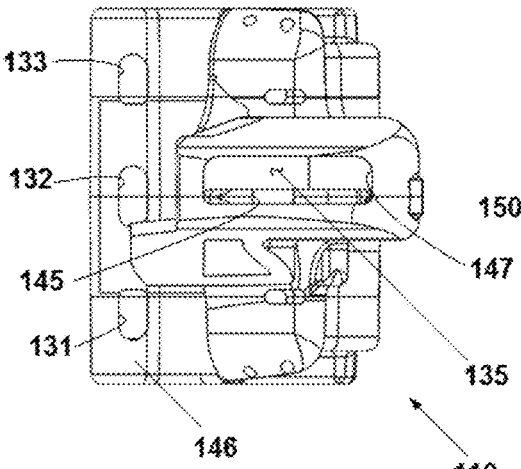
FIG. 3 is a front elevation view of the tail thereof.
Figure 4:
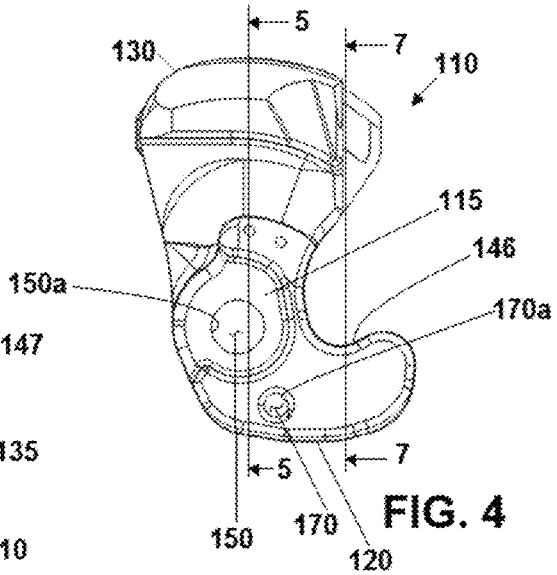
FIG. 4 is a top plan view thereof.

As shown in FIG. 1, the coupler knuckle 110 has a plurality of openings 141,142,143,144,145 provided in the nose section 120. The openings 141,142,143,144,145, respectively, communicate with and open into the respective nose cavities 124,125,121,122 and 128. Referring to FIG. 3, the knuckle 110 is shown having openings 131,132,133 providing on or near the throat wall 146.

The knuckle 110 has a pin bore 150 formed therein. As shown in FIGS. 5 and 8, the pin bore 150 extends vertically through the nose area of the knuckle 110 and, in the embodiment illustrated, is formed in each of the spaced apart layers 115,116,117,118, each respective layer being shown with a bore 150*a*,150*b*,150*c*,150*d*, respectively, provided therein. The bores 150*a*,150*b*,150*c*,150*d* are aligned to form a continuous pin bore 150 extending through the knuckle 110. In the embodiment of the knuckle 110 illustrated, the cavities 124,128,121 are shown communicating with the pin bore 150. A flag hole 170 is provided in the knuckle 110 and preferably extends into the top layer 115 thereof Referring to FIGS. 6, 7 and 8, the flag hole 170 may extend into the knuckle 110 and preferably may be formed by a plurality of holes 170*a*,170*b*,170*c* provided in the respective layers 115,116,117. The flag hole 170 may extend to or into the lower layer 118, but not through it, while in alternate embodiments, the flag hole 170 may pass through the bottom of the knuckle 110, or into it without extending through it.

Pulling lugs 178,179 are provided on the tail section 130. According to a preferred embodiment, the upper pulling lug 178 is provided at the tail section upper portion 160 and is illustrated being transversely aligned in a pulling direction and being aligned with the first mid layer 116. The lower pulling lug 179 is provided at the tail section lower portion 161 and is illustrated being transversely aligned in a pulling direction and being aligned with the second mid layer 117. The upper lug 178 is shown connected to the upper wall 162 and the lower lug 179 is shown connected to the lower wall 163. According to the preferred embodiment illustrated, the upper lug 178 is shown spaced apart from the lower lug 179, and preferably is spaced by the channel 136.

According to a preferred construction, the transverse layers 115,116,117,118 are provided along a path parallel to the anticipated force direction that the knuckle 110 handles when a pulling force is applied to the knuckle 110. The arrangement of the interior layers 115,116,117,118 of the knuckle 110 preferably allows force loads to be handled through the knuckle in preferred directions.

Figure 9:
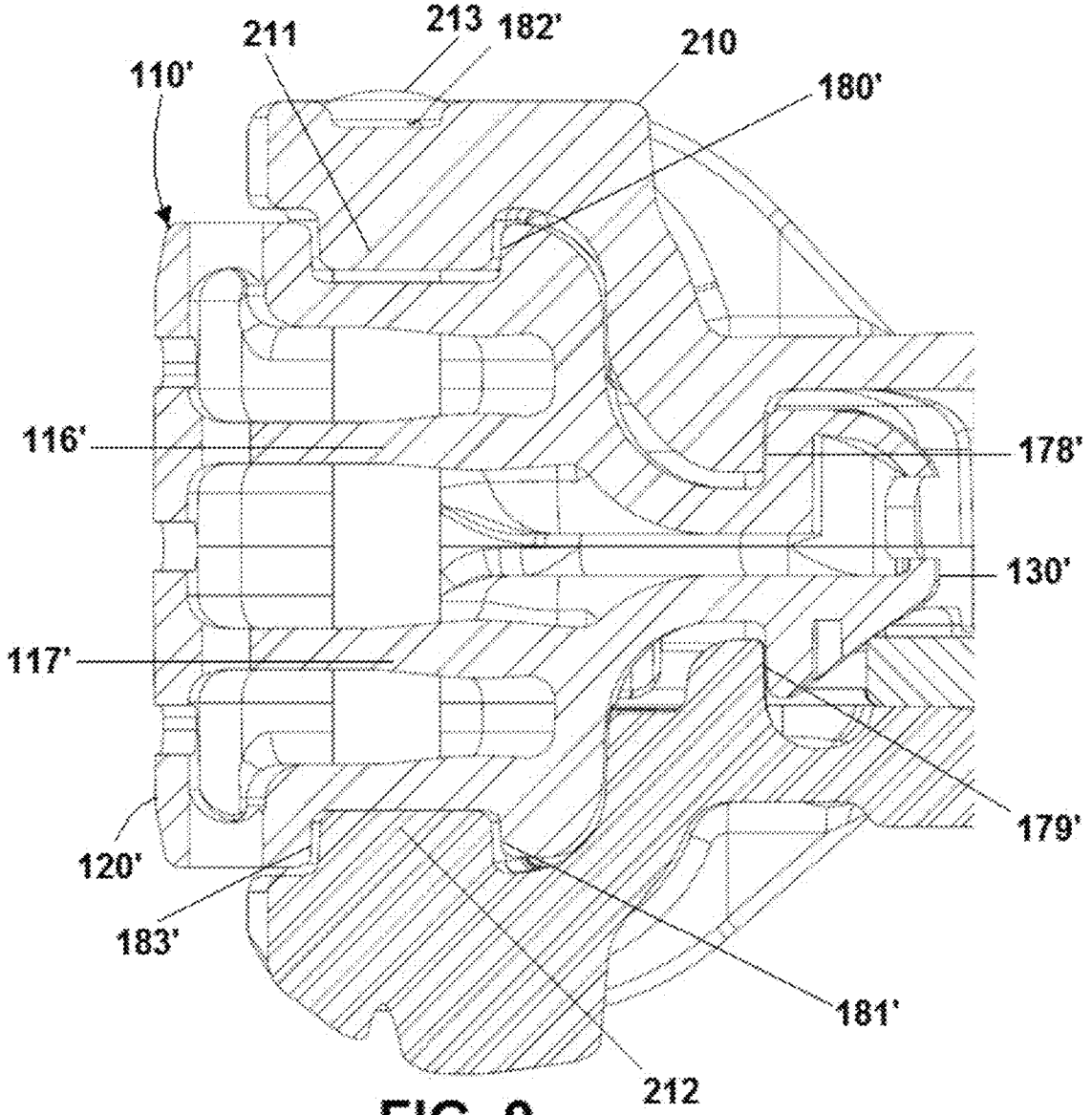
FIG. 9 is a sectional view of a preferred embodiment of a knuckle according to the invention, shown installed in a coupler head.
Figure 10:
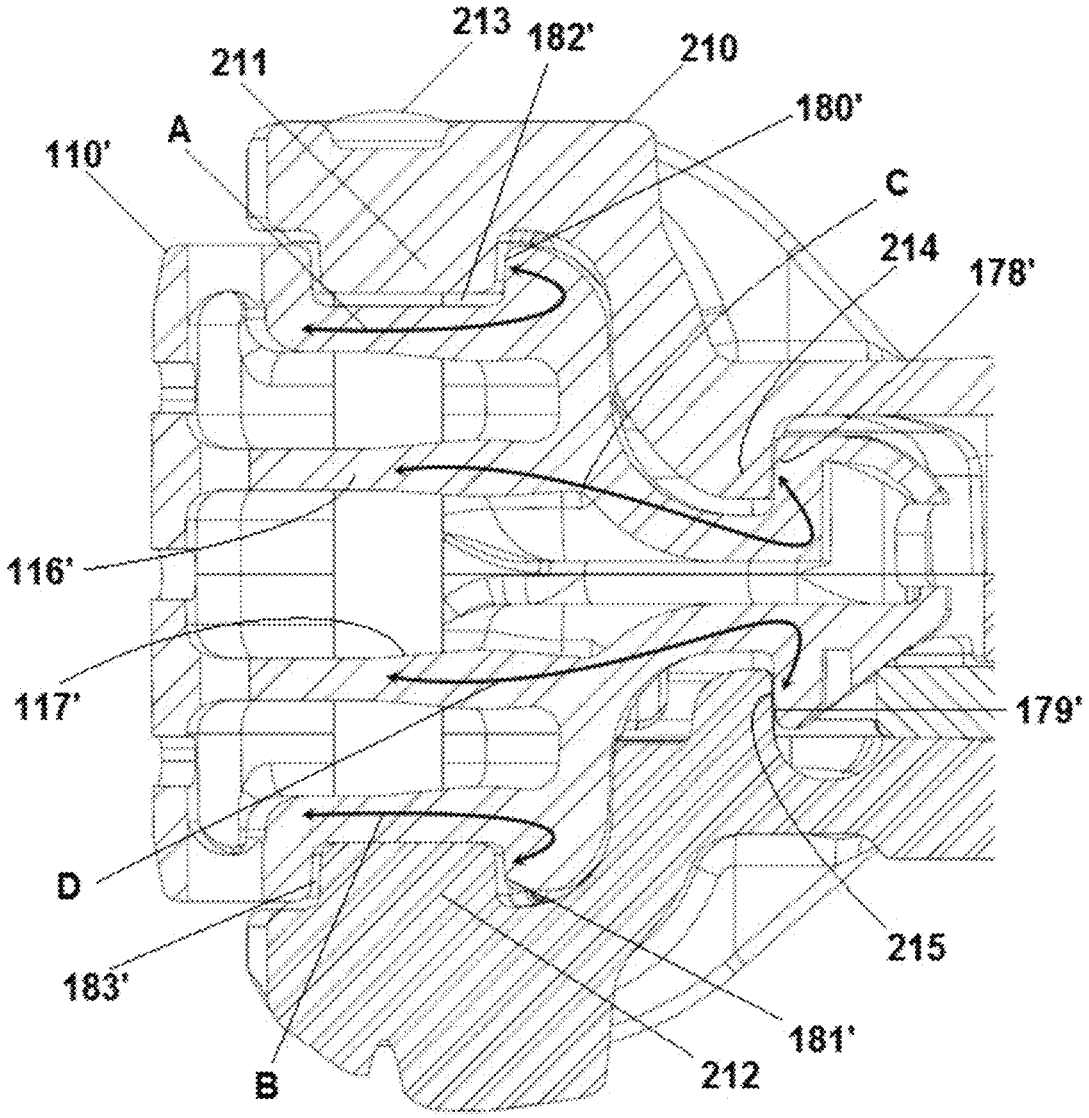
FIG. 10 is a sectional view of the knuckle embodiment and coupler head shown in FIG. 9, but illustrating force handling in a preferred knuckle configuration.
Figure 11:
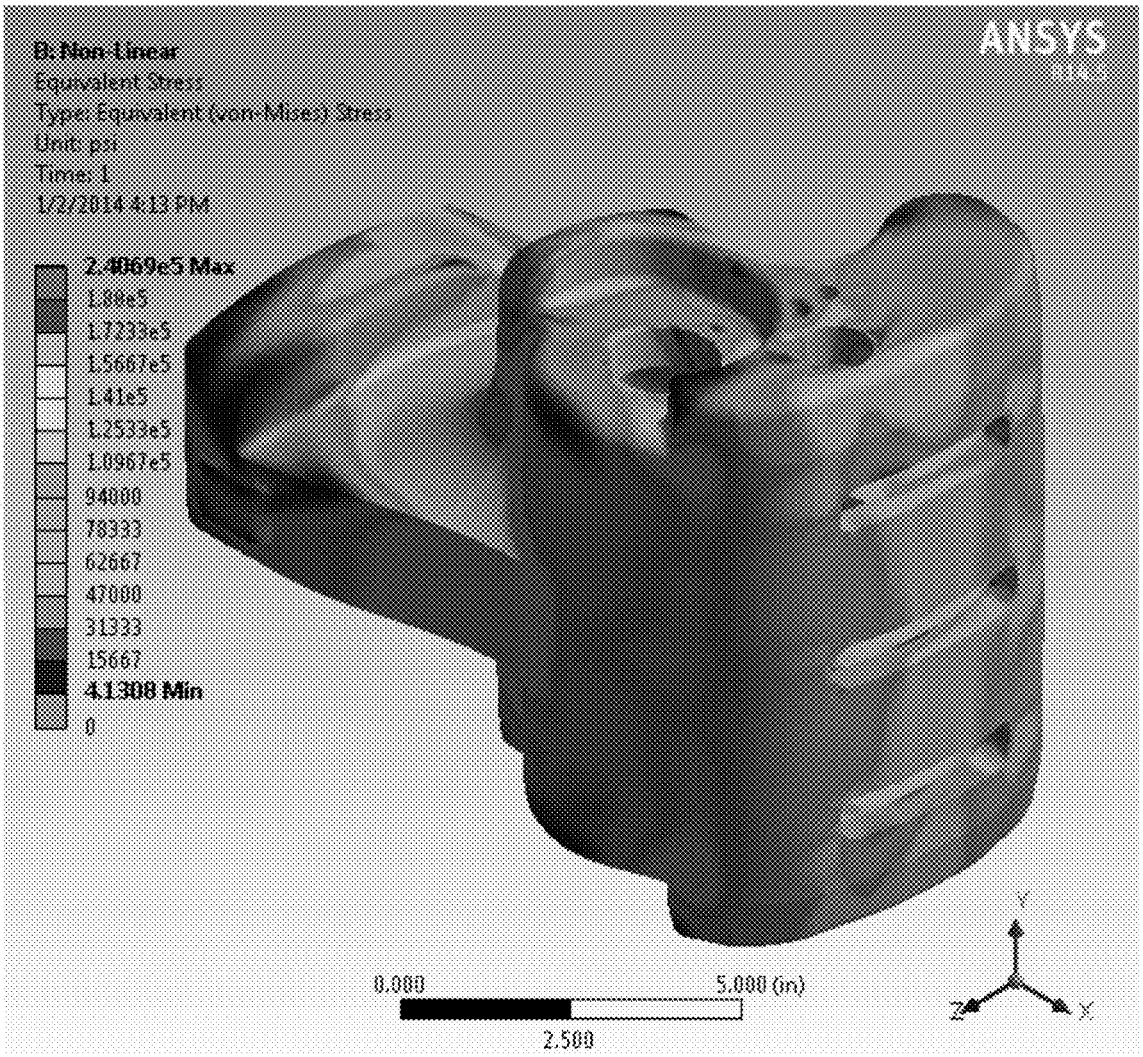
Figure 12:
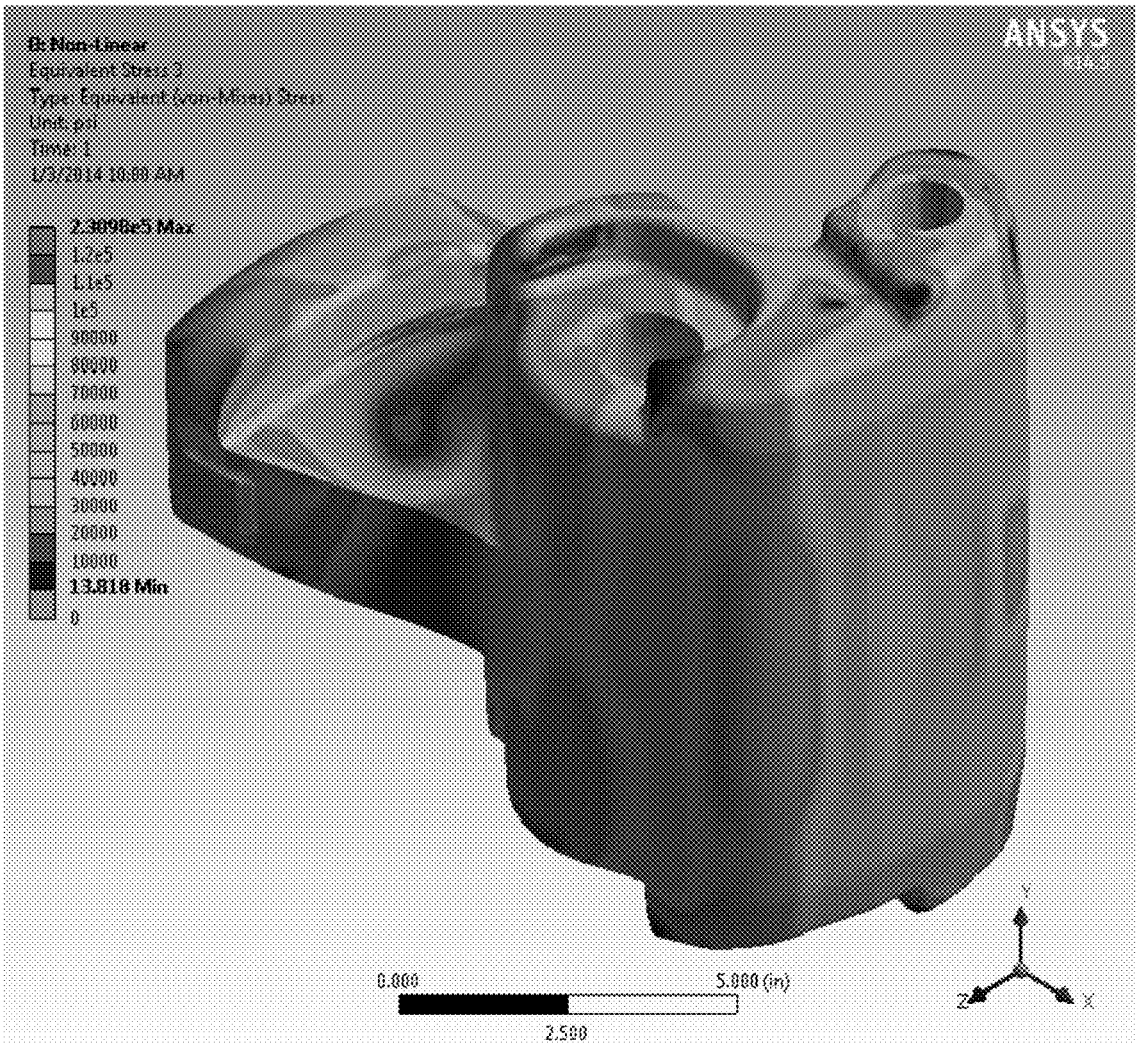
Figure 13:
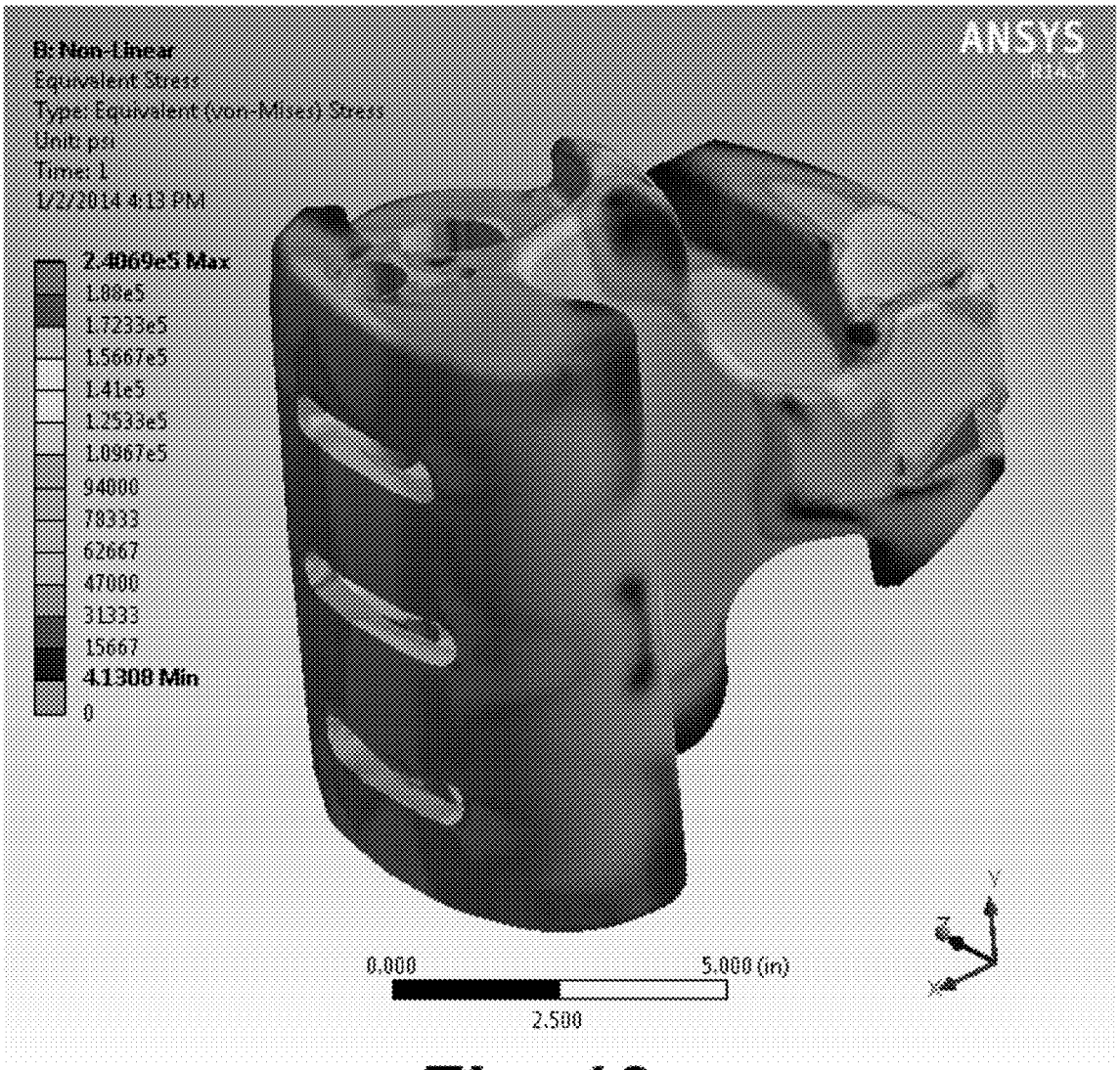
Figure 14:
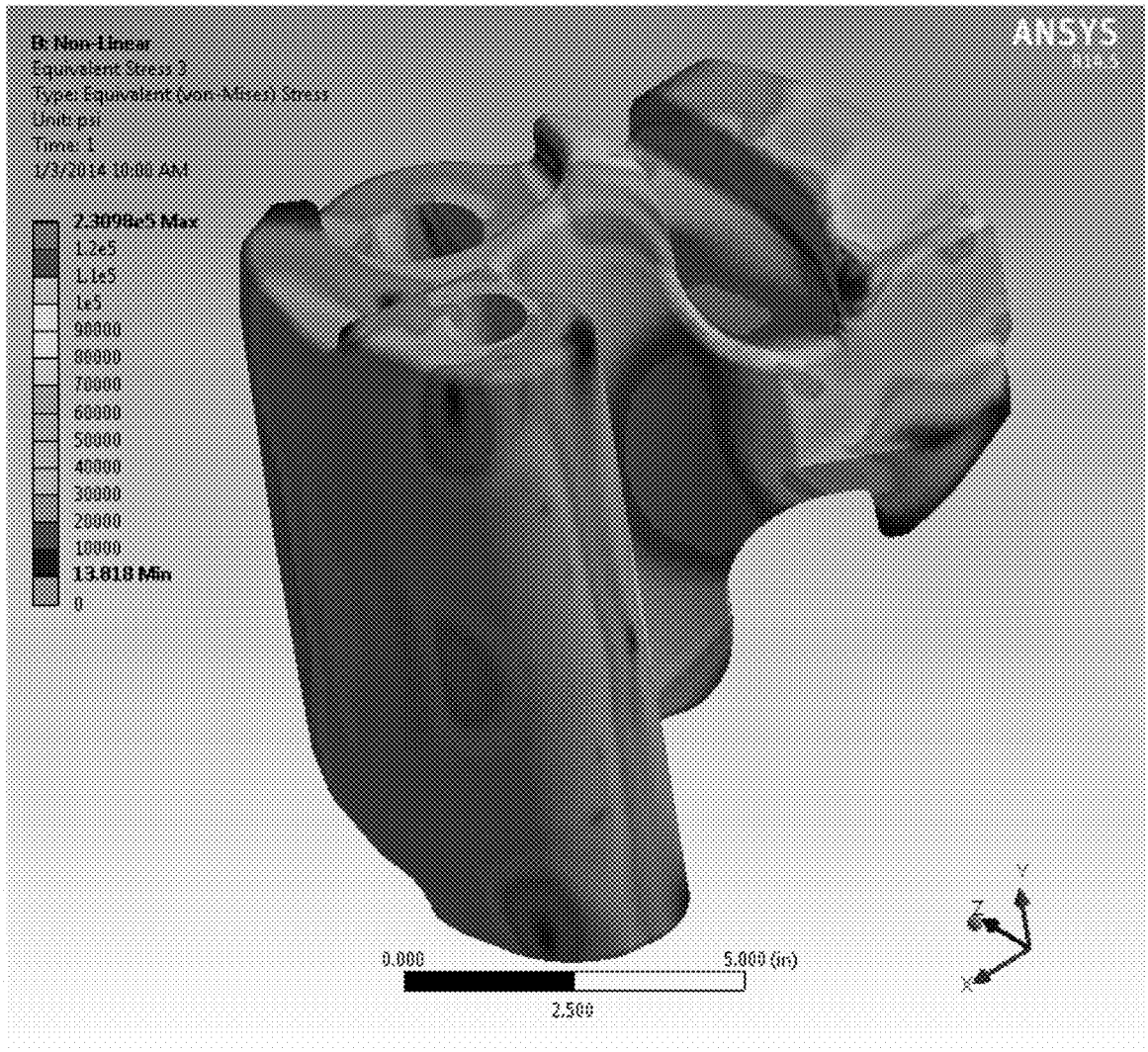
Figure 15:
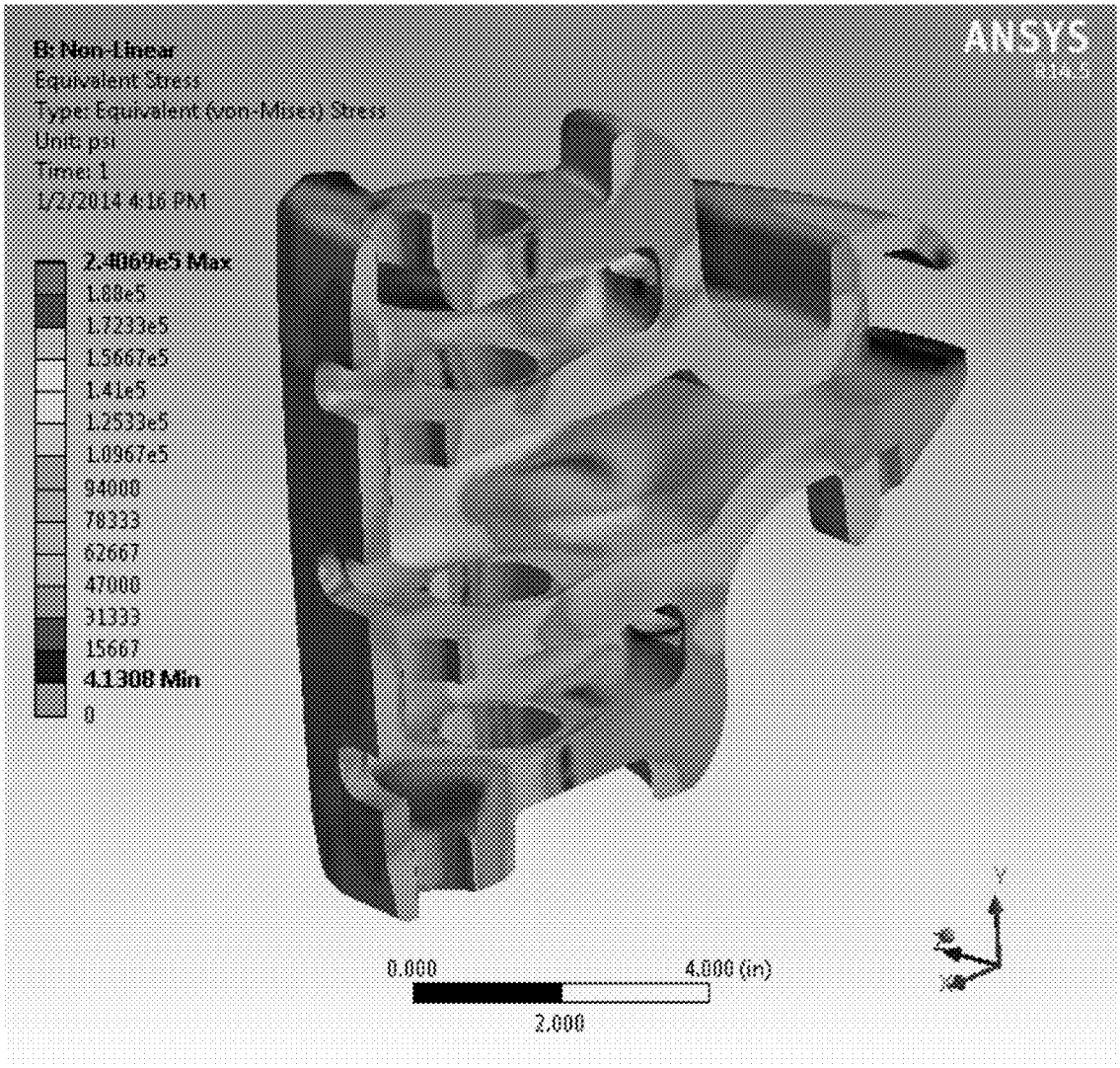
Figure 16:
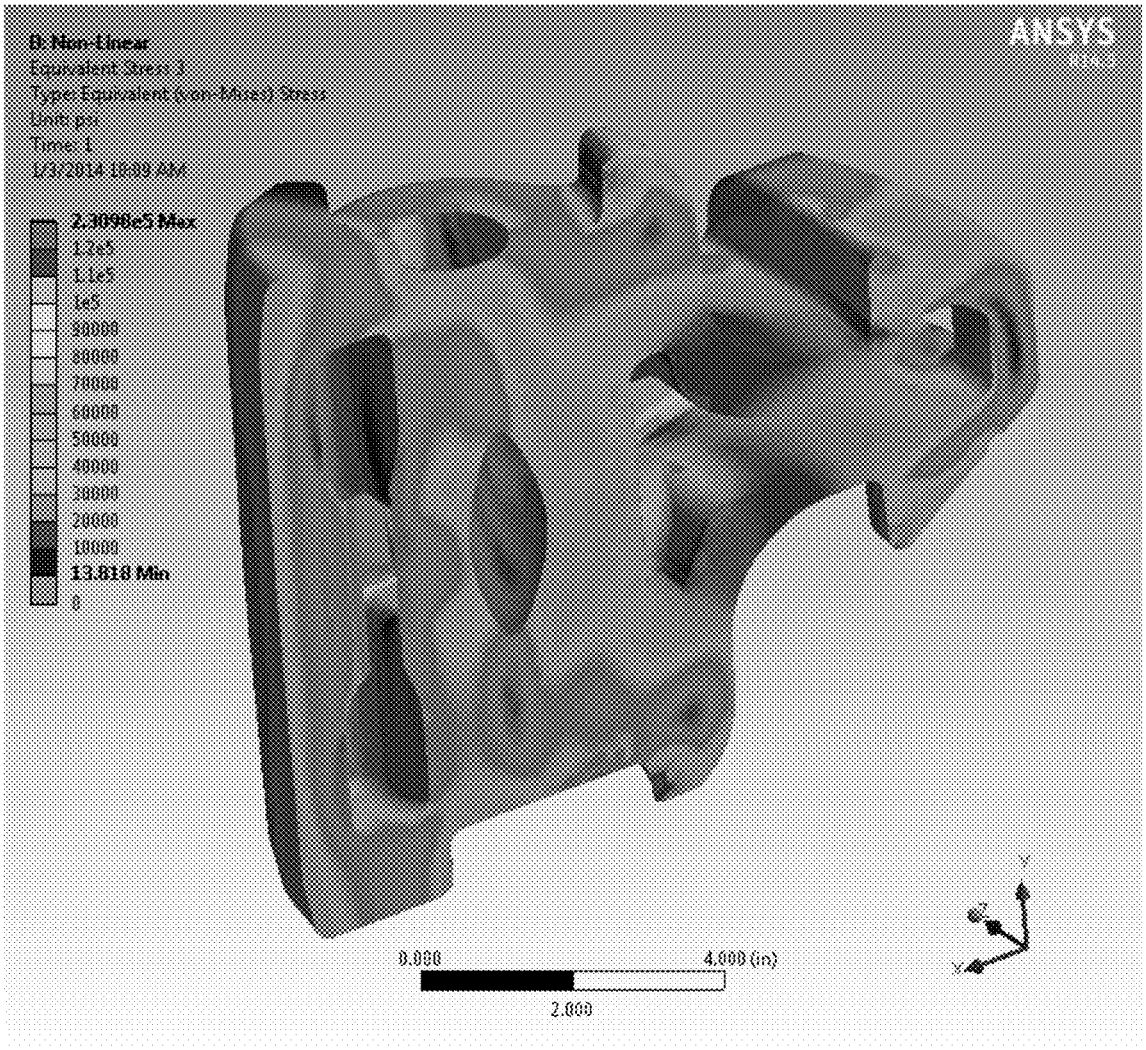
Figure 17:
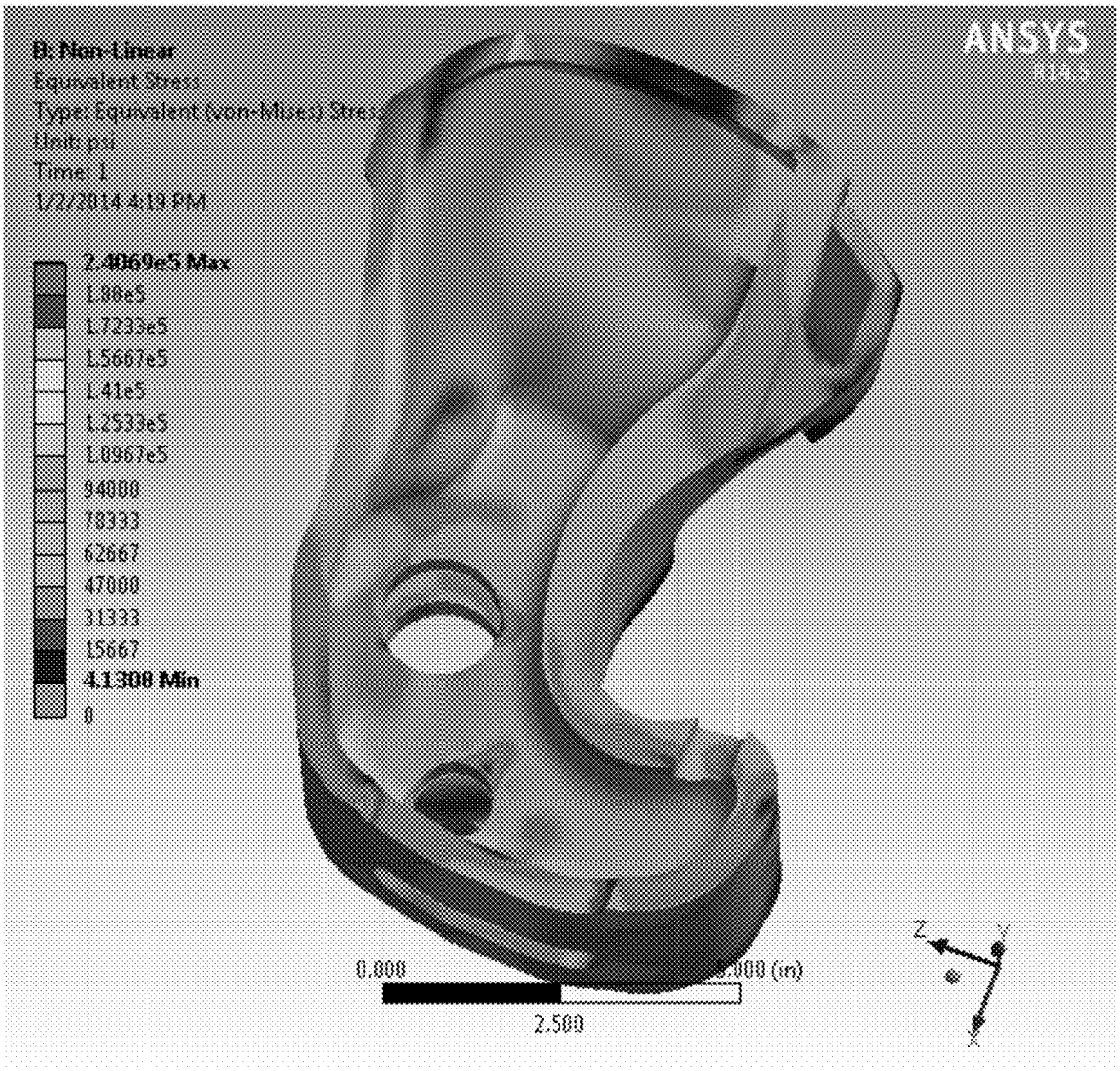
Figure 18:
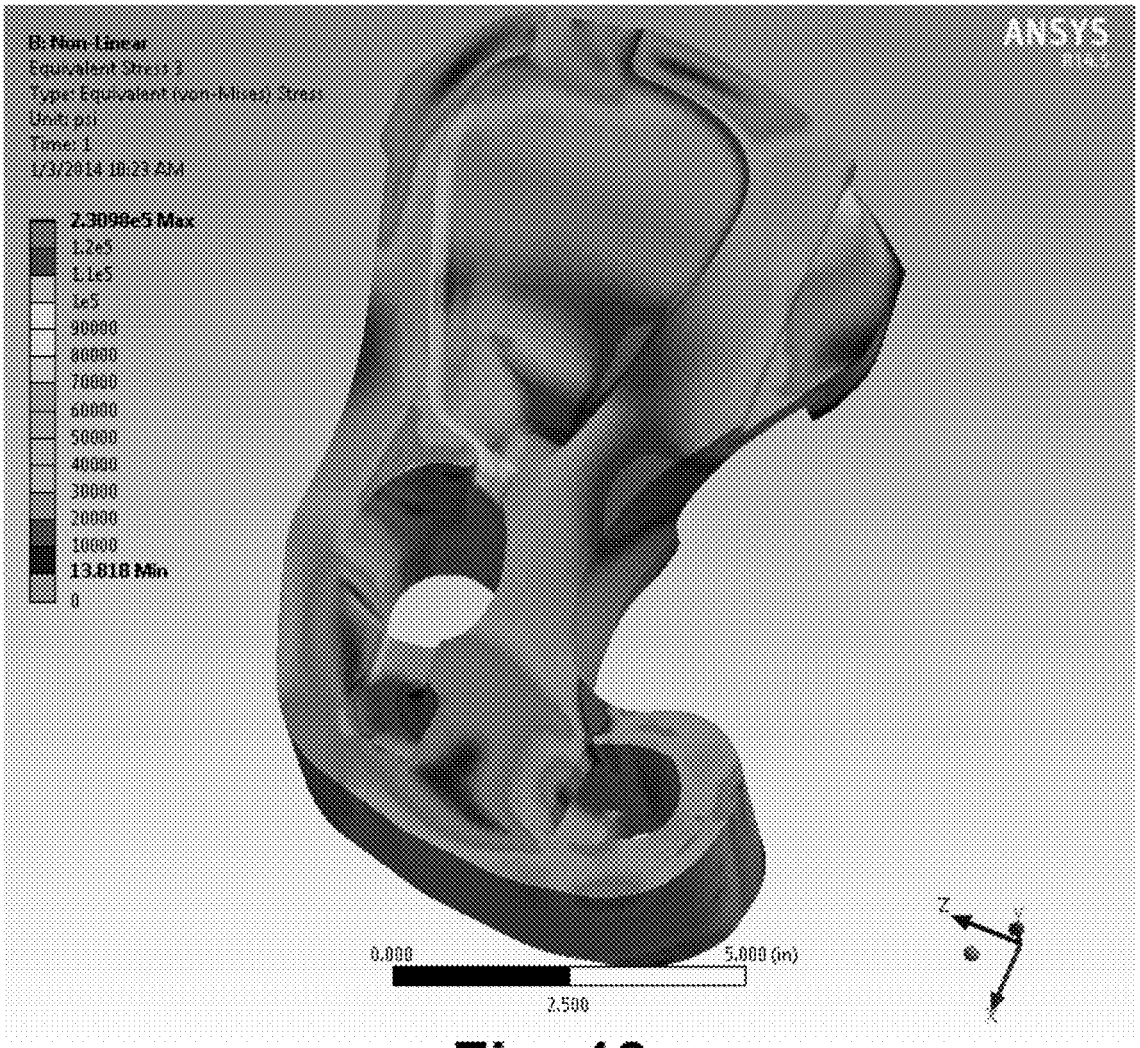
Figure 19:
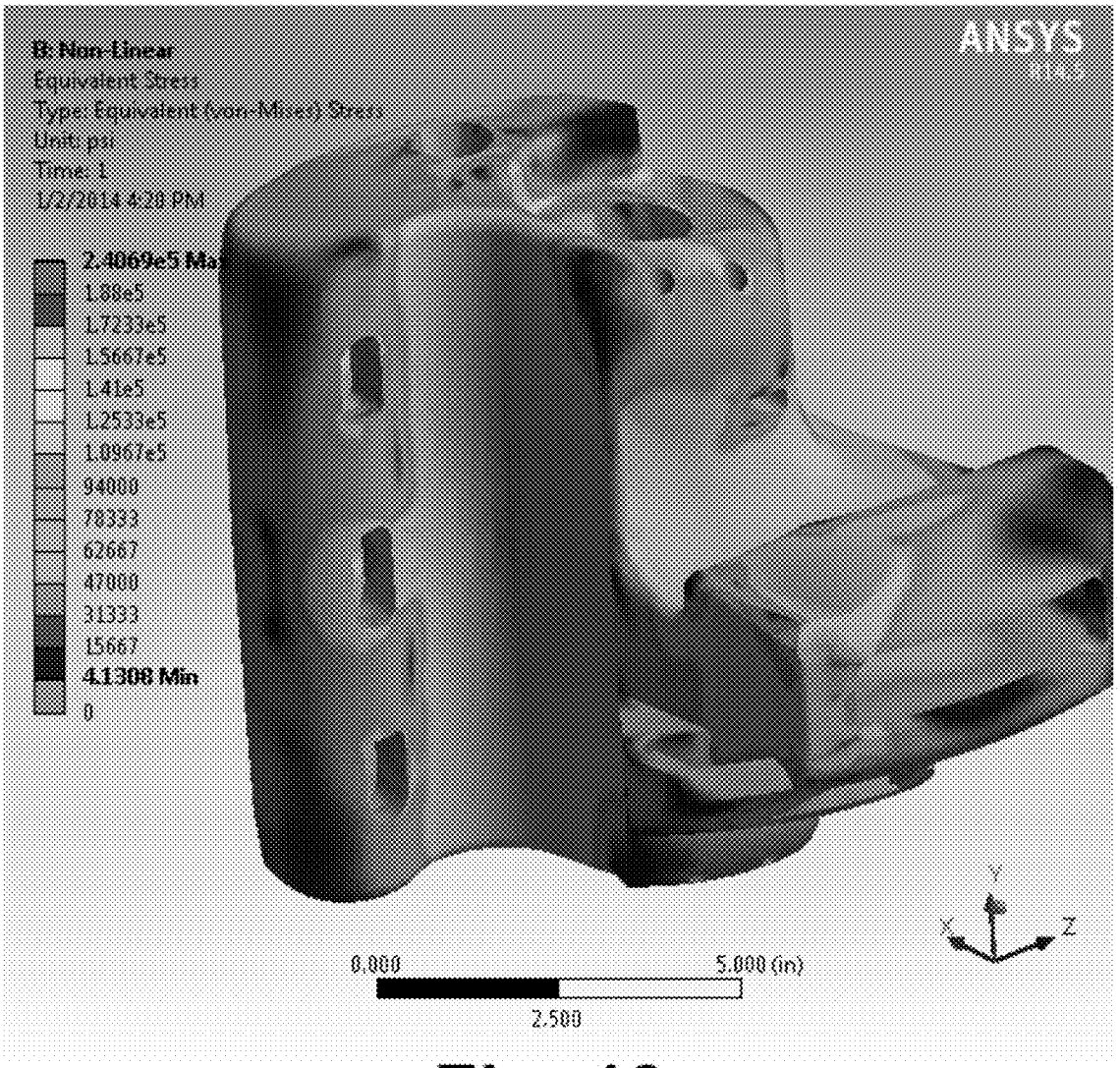
Figure 20:
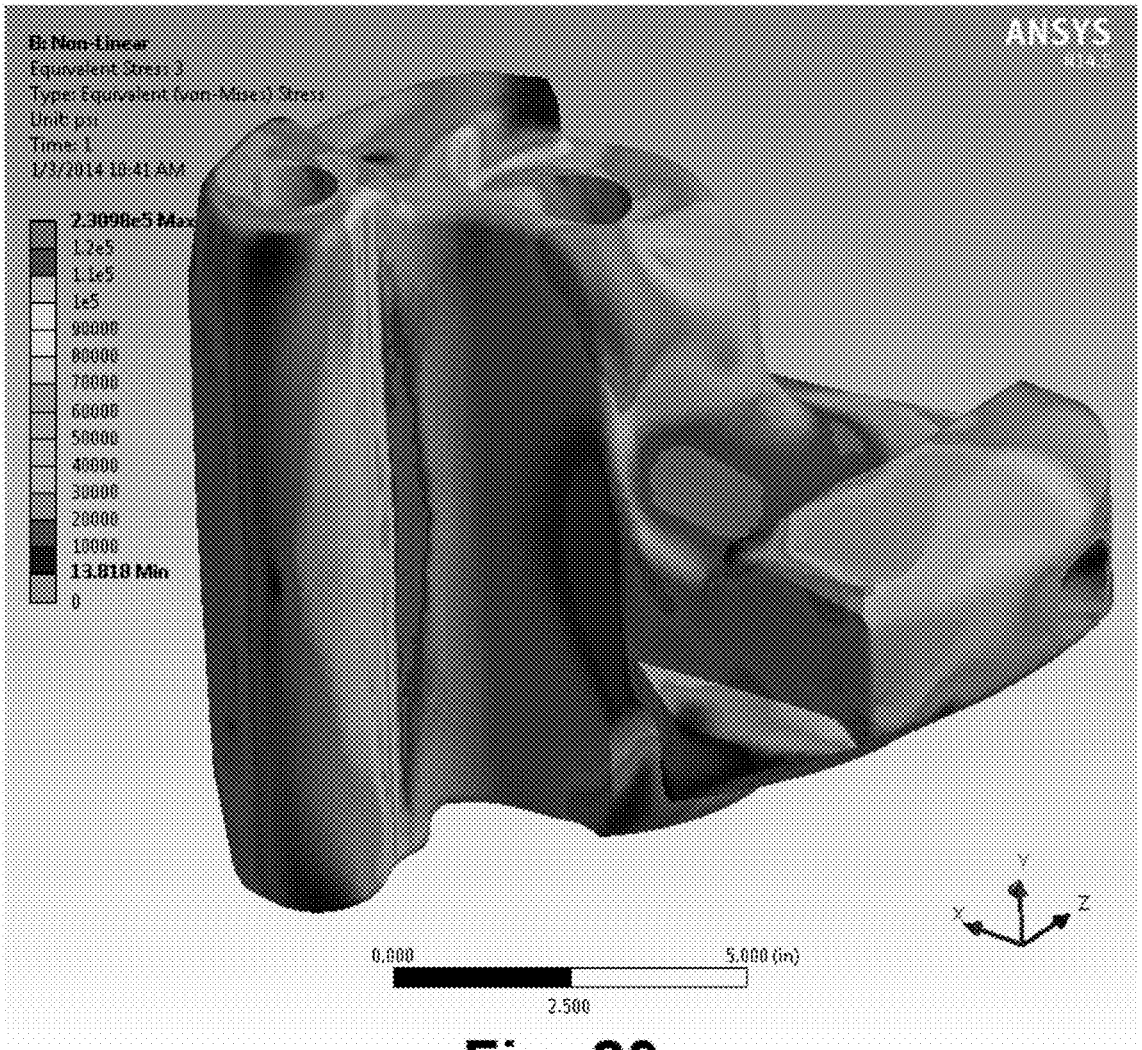

Referring to FIG. 9, a knuckle 110' is illustrated shown installed on a coupler head 210. The example of a coupler head 210 is shown to illustrate an environment showing how the knuckle 110, 110' may be used. The knuckle 110' may be constructed as shown and described in accordance with the knuckle 110. The knuckle 110' has lugs 178',179' of the tail section 130' which engage with the coupler head 210. Preferably, as shown, the knuckle 110' has an upper pulling ridge 180' and lower pulling ridge 181' which form upper and lower recesses 182',183'. The coupler jaws 211,212 are shown respectively disposed in the upper and lower recesses 182',183' formed by the upper and lower ridges 180',181, respectively at the top and bottom of the knuckle 110'. The coupler 210 also has a tail engaging upper shoulder 214 that engages with the upper lug 178' and a lower shoulder 215 that engages with the lower lug 179'. A pin 213 is shown extending through the coupler jaws 211,212 and the knuckle 110' to pivotally connect the knuckle 110' with the coupler head 210. As shown in FIG. 10, a preferred force handling is accomplished through the coupler knuckle 110', which is shown in an exemplary arrangement with a coupler head 210 to illustrate preferred force handling for the knuckle 110' illustrated. The illustration of FIG. 10 is an example of force directions handled through a knuckle 110'. The force handling includes a first force directional component or path represented by the double arrow "A". A second force handling directional component or path is shown represented by the double arrow "B". A third or mid directional component or path is shown represented by the double arrow "C" and a fourth or mid directional component or path is shown represented by the double arrow "D". The preferred force handling configuration allows for linear loading between the internal ribs or mid-layers 116',117' and draft lugs 178',179'. The preferred configuration facilitates equalization of load distribution between interfaces.

According to some preferred embodiments, knuckles according to the invention provide improved force handling. Illustrations of force handling utilizing the stress indication provided by the von-Mises stress test are represented in the illustrations depicted in FIGS. 11 through 20, where FIGS. 11, 13, 15, 17 and 19 show stress results for a knuckle according to the present invention, and wherein FIGS. 12, 14, 16, 18 and 20 show stress results for a prior art type E coupler knuckle.

According to a preferred construction, the coupler knuckle is made from a suitably strong material. One material is steel, and preferably grade E steel. According to some preferred embodiments, the coupler knuckle is made from austempered metal, such as, for example, austempered ductile iron, austempered steel, as well as other austempered metals and austempered metal alloys. The coupler knuckle made from austempered ductile iron (ADI) may be produced using a suitable austempering process. For example, austempering of ductile iron may be accomplished by heat-treating cast ductile iron to which specific amounts of nickel, manganese, molybdenum, or copper, magnesium or combinations thereof have been added to improve hardenability. Austempered steel and other austempered metals and austempered metal alloys, may be produced by any suitable austempering process.

According to one embodiment, the knuckle has improved fatigue-resistance and is lighter in weight than existing current knuckles. When constructing the coupler knuckle from an ADI having a specific gravity of about 0.26 lbs/in^3, the density is less than that of grade E cast steel, 0.283 lbs/in^3 and a weight reduction of about 8% may be achieved using the ADI to construct the knuckle 110 versus using grade E cast steel.

According to an alternate embodiment, the knuckle 110 may be constructed from austempered steel. Austempered steel is produced by a suitable austempering process. For example, austempering of steel may be accomplished by heat-treating cast steel to which specific amounts of chromium, magnesium, manganese, nickel, molybdenum, or copper, or combinations thereof, have been added to improve hardenability; the quantities of the elements needed to produce the austempered steel from the cast alloy steel are related to the knuckle configurations and, for example, may depend on the thickest cross-sectional area of the knuckle.

According to alternate embodiments, the knuckle 110 may be formed using a molding process where the molten material is added to a mold. According to one embodiment, the knuckle 110 is constructed by forming a wax casting, where the wax is coated with a suitable material that can receive the molten metal. The wax is then removed from the coating that becomes the mold, and molten material is then introduced into the coating. The material may be subject to a suitable austenitizing process to produce a knuckle made from austempered metal.

Alternatively, the knuckle 110 may be formed by an alternative process that involves constructing a mold that is the shape of the knuckle 110, where the mold is formed from a material that is designed to disintegrate when contacted with the molten material that is to form the knuckle 110. A preferred method is set forth in co-pending U.S. patent application Ser. No. 14/171,700, filed on Feb. 3, 2014, for a process for producing a coupler knuckle and improved coupler knuckle. One preferred method involves forming the mold that resembles the knuckle 110, where the mold has the same and shape and volume of the knuckle 110 to be produced. The mold may be formed using injection molding, three dimensional (3-D) printing or other suitable procedure. The mold resembling the knuckle 110 in shape and volume is then coated with a coating that covers the interior and exterior surfaces of the mold. The coating may be applied one or more times, and may be applied by brushing, spraying, immersing, or other suitable application process. The mold interior spaces that are to remain as cavities in the formed knuckle 110 preferably are filled with an inert material, such as sand. The material that is to form the knuckle 110 is then introduced into the mold to contact the disintegratable mold material forming the mold, and the molten metal occupies the space that the mold previously had. The mold coating, which is made from a material that does not melt or degrade when exposed to the molten metal, remains and contains the molten metal. According to this method, preferably, the mold that is within the coating disintegrates by decomposing to form by products, such as a gas that passes through the coating. The molten metal may be subjected to an austenitizing process. Once the molten material used to form the knuckle 110 has been allowed to cure, then the knuckle 110 may be broken away from the coating to provide a formed product.

Although preferred methods for constructing the knuckle 110 are provided, alternate methods may be used to form the knuckle 110. Methods that involve the use of cores placed in a jig, although less preferred than other methods, may be used to form the knuckle 110.

These and other advantages may be realized with the present invention. While the invention has been described with reference to specific embodiments, the description is illustrative and is not to be construed as limiting the scope of the invention. The knuckles according to the invention preferably also may be constructed to have improved surface finishes to provide higher fatigue strength. Preferred embodiments may be provided having a surface finish of 125-175 RMS. According to some preferred embodiments, the knuckles 110,110' may be constructed having wall thicknesses preferably from between about 0.25 in. and about 1.5 in., and more preferably from between about 0.25 in to 1.25 in. In addition, according to some preferred embodiments, the coupler knuckles according to the invention may be constructed having the advantages discussed herein and meet the AAR specification, M-216. Coupler knuckles according to some embodiments may be constructed to weigh about 25 lbs. less than standard knuckles, which for example weigh 85 lbs. For example, a 60 lb. knuckle according to the invention may result in a savings of 50 lb. per car, allowing for more payload. The knuckles of the invention although constructed to be lower in weight preferably also are stronger and less resistant to fatigue. Various modifications and changes may occur to those skilled in the art without departing from the spirit and scope of the invention described herein and as defined by the appended claims.

What is claimed is:

1. A coupler knuckle having an improved interior configuration for facilitating improved force handling, wherein said coupler knuckle includes force handling means for handling forces imparted on the knuckle and transferring said imparted forces through the knuckle;

wherein said force handling means comprises a force handling structure; and wherein said force handling structure comprises a plurality of transverse layers being spaced apart and separated by cavities;

the knuckle having a nose area, wherein said spaced apart transverse layers are provided in the nose area of the knuckle, and wherein the knuckle has a pin bore, wherein said pin bore is formed in each of said spaced apart transverse layers, and wherein the respective pin bores in each spaced apart transverse layer are aligned to form a continuous pin bore extending through the coupler knuckle.

2. The coupler knuckle of claim 1, having a tail section, wherein at least one of the cavities comprises a transverse cavity that spans from the tail section to the nose area and passes through the pin bore.

3. The coupler knuckle of claim 2, wherein said nose area comprises a nose wall, and wherein the transverse cavity spanning from the tail section to the nose section extends to the nose wall.

4. The coupler knuckle of claim 3, wherein the nose wall is transversely disposed relative to the at least one transverse cavity.

5. The coupler of claim 2, wherein said transverse cavity spans unrestricted between the tail section and the nose area.

6. The coupler of claim 5, wherein the transverse cavity has a first lateral side and a second lateral side, wherein the coupler knuckle has a first side wall with an interior and an exterior, a second side wall with an interior and an exterior, wherein said transverse cavity is defined by the first side wall interior and the second side wall interior of the knuckle, and wherein said first side wall interior and said second side wall interior form lateral sides of the transverse cavity.

7. The coupler knuckle of claim 1, including draft lugs, wherein said plurality of transverse layers comprises at least two mid layers, and wherein each mid layer is aligned with a draft lug.

8. The coupler knuckle of claim 1, including a pin hole, and wherein said transverse layers are disposed laterally outward from a center plane passing through the pin hole.

9. The coupler knuckle of claim 1, including a pin hole, wherein said transverse layers form a nose section of said knuckle and a tail section of said knuckle, wherein said knuckle tail section is disposed laterally outward on each side of a center plane passing through the pin hole, and wherein the side of the knuckle is disposed substantially laterally away from the center plane.

10. The coupler knuckle of claim 1, wherein said wherein said coupler knuckle is constructed from grade E steel.

11. The coupler knuckle of claim 1, wherein said coupler knuckle is constructed from an austempered material.

12. The coupler knuckle of claim 11, wherein said austempered material is austempered metal.

13. The coupler knuckle of claim 12, wherein said austempered metal is austempered ductile iron.

14. The coupler knuckle of claim 12, wherein said austempered metal is austempered steel.

15. The coupler knuckle of claim 12, wherein said austempered metal is selected from the group consisting of austempered ductile iron, austempered steel and austempered alloy steel.

16. The coupler knuckle of claim 13, wherein said austempered ductile iron comprises ductile iron alloyed with one or more metals selected from the group consisting of nickel, molybdenum, manganese, copper and mixtures thereof, wherein said ductile iron alloyed with said one or more said metals is austempered to produce said coupler knuckle.

17. The coupler knuckle of claim 1, wherein said cavities are provided between said spaced apart transverse layers, and where said cavities are defined by adjacently spaced apart layers, and wherein each one of said plurality of cavities communicates with said pin bore.

18. The coupler knuckle of claim 17, wherein said coupler knuckle has a nose area and a tail section, wherein said spaced apart transverse layers include a top layer, a bottom layer, and two mid layers, wherein each mid layer extends from the nose area of the coupler knuckle to the tail section of the coupler knuckle, wherein each of said mid layers has at least a portion thereof disposed in the knuckle interior and at least another portion thereof that forms an exterior of said knuckle.

19. The coupler knuckle of claim 1, wherein said transverse layers are provided along a path parallel to the forceload direction.

20. The coupler knuckle of claim 1, wherein the knuckle has a tail, wherein said tail includes pulling areas thereon, and wherein said spaced apart layers are disposed in a parallel arrangement and are transversely aligned with the pulling areas of the knuckle tail.

21. The coupler knuckle of claim 1, said coupler knuckle having a nose area and a tail section, wherein said coupler knuckle has pulling lugs on the tail section.

22. The coupler knuckle of claim 1, said coupler knuckle having a nose area and a tail section, wherein said coupler knuckle has pulling lugs on the tail section, and wherein each of said pulling lugs is aligned with at least one of said plurality of transverse layers in a pulling direction.

23. The coupler knuckle of claim 1, wherein said knuckle has a wall forming the exterior of the nose area, said wall having an exterior surface forming an exterior surface of the coupler knuckle, and said wall having an interior, said wall interior connecting with said plurality of transverse spaced apart layers.

* * * * *